310-14 SR
7/2/85 XR 4,526,517

United States Patent [19]

Clegg

[11] Patent Number: 4,526,517

[45] Date of Patent: Jul. 2, 1985

[54] CIRCULAR CENTRIFUGAL PUMP WITH ARCUATE INPUT AND OUTPUT SECTIONS

[76] Inventor: Warren P. Clegg, P.O. Box 70133, Houston, Tex. 77270

[21] Appl. No.: 578,587

[22] Filed: Feb. 9, 1984

[51] Int. Cl.[3] ..... F04B 17/04; F01D 1/00

[52] U.S. Cl. ..... 417/355; 417/423 R; 310/14; 415/92; 415/202

[58] Field of Search ..... 417/355, 356, 423 R, 417/410, 424; 415/52, 92, 202, 152 R; 310/14, 12, 46

[56] References Cited

U.S. PATENT DOCUMENTS

| | | | |
|---|---|---|---|
| 1,071,847 | 9/1913 | Wilson | 310/14 |
| 3,496,871 | 2/1970 | Stengel | 417/410 |
| 3,847,502 | 11/1974 | Isbell | 417/410 |
| 4,104,548 | 8/1978 | Borello | 310/14 |
| 4,291,248 | 9/1981 | Rainbolt | 310/46 |
| 4,295,803 | 10/1981 | Barthelmess | 417/423 R |
| 4,381,181 | 4/1983 | Clegg | 417/423 R |

*Primary Examiner*—Cornelius J. Husar
*Assistant Examiner*—Peter M. Cuomo
*Attorney, Agent, or Firm*—Edmund F. Bard

[57] ABSTRACT

In a centrifugal pump, a pumping section comprising a circular conduit has an input section subtending an arc on the circle. A plurality of channels connect the input section to an input conduit subtending an arc of a circle smaller than and concentric with or parallel to and vertically displaced from the circle defined by the pumping section. An output section subtends an arc defined by a circle concentric with and larger than the pumping section or vertically displaced therefrom. An impeller comprising vanes mounted on an annular disk is mounted in the pumping section and has magnetically saturable sections angularly spaced thereon driven by coils surrounding the pumping section and angularly spaced therealong.

10 Claims, 8 Drawing Figures

CIRCULAR CENTRIFUGAL PUMP WITH ARCUATE INPUT AND OUTPUT SECTIONS

BACKGROUND OF THE INVENTION

This invention relates to centrifugal pumps and more particularly to a centrifugal pump with no central rotating shaft.

This invention relates to a centrifugal pump including a pumping section housed in a circular conduit, preferably toroidal housing impeller means defining an annulus which annulus is driven by electromagnetic force supplied by coils surrounding the pumping section and angularly spaced therealong. In this regard, the invention may be regarded as an improvement over the method and apparatus disclosed in my U.S. Pat. No. 4,381,181 issued on Apr. 26, 1983, the disclosure of which is incorporated herein by reference.

It is desired to provide a pump of this type with improved inlet and outlet means, an even more effective impeller and a conduit structure in which joints in the conduit in a plane normal to the direction of travel of the impeller are not required to provide an opening through which the impeller means may be inserted or removed.

SUMMARY OF THE INVENTION

It is therefore an object of the present invention to provide a centrifugal pump incorporating a circular pumping section in which inlet and outlet sections may each subtend an arc of a circle concentric with or parallel to a circle defined by the pumping section.

It is a further object of the present invention to provide a pump of the type described in which a plurality of pumping sections may be cascaded.

It is also an object of the present invention to provide a pump of the type described with an impeller structure, pumping structure and pumping section structure for facilitating efficient movement of the impeller and convenient assembly and disassembly of the apparatus.

Briefly stated, in accordance with the present invention there is provided a pumping section comprising a circular conduit and having an input section subtending an arc on the circle. A plurality of channels connect the input section to an input conduit subtending an arc of a circle smaller than and concentric with or parallel to and vertically displaced from the circle defined by the pumping section. An output section subtends an arc defined by a circle concentric with and larger than the pumping section or vertically displaced therefrom. An impeller comprising vanes mounted on an annular disk is mounted in the pumping section and has magnetically saturable sections angularly spaced thereon driven by coils surrounding the pumping section and angularly spaced therealong.

BRIEF DESCRIPTION OF THE DRAWINGS

The means by which the foregoing objects and features of invention are achieved are pointed out with particularity in the claims forming the concluding portion of the specification. The invention, both as to its organization and manner of operation are further described with respect to the following drawings.

Of the drawings.

DESCRIPTION OF THE PREFERRED EMBODIMENTS

Figure 1:
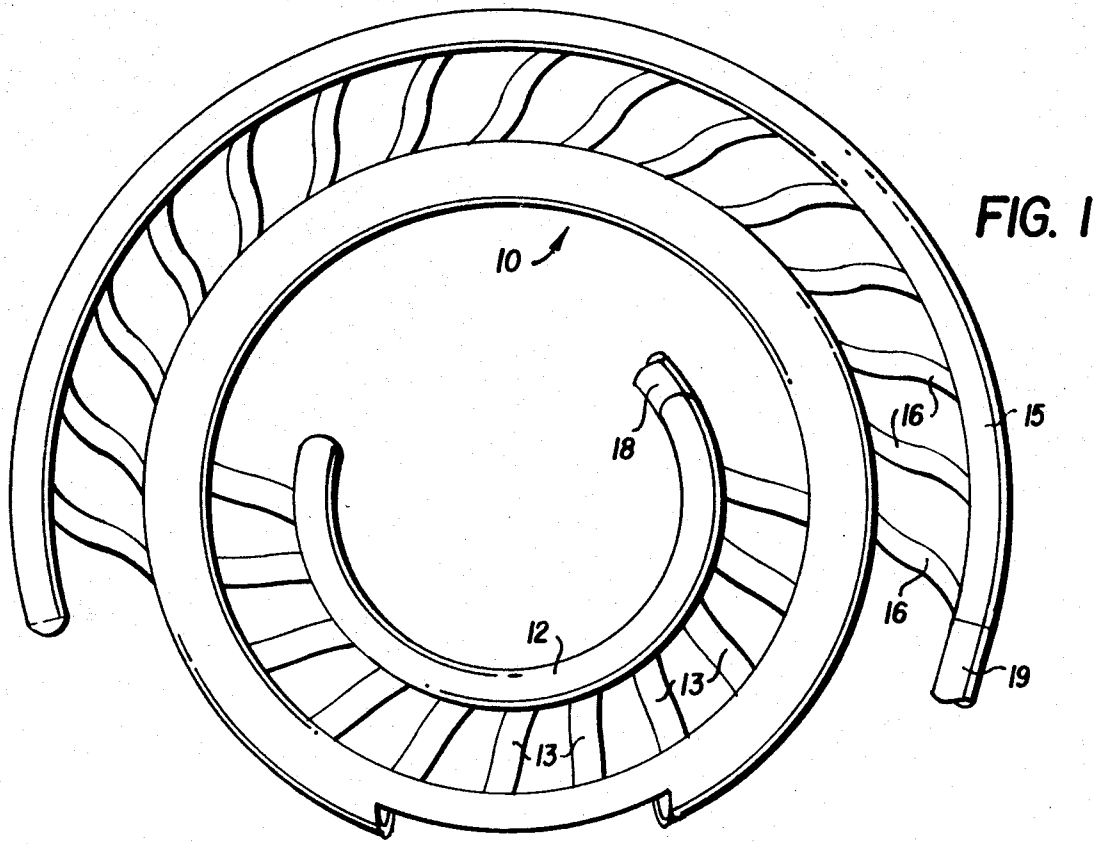
FIG. 1 is a plan view of apparatus constructed in accordance with the present invention illustrating inlet, outlet and pumping sections but not illustrating the windings which drive the impeller.
Figure 2:
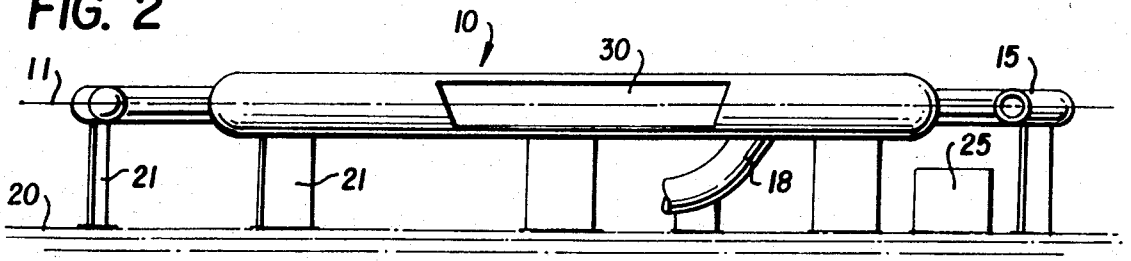
FIG. 2 is an elevation of the apparatus in FIG. 1.

FIGS. 1 and 2 are respectively a plan and elevation of an apparatus constructed in accordance with the present invention, but not illustrating the coil windings, which are placed around the pumping section as described with respect to FIGS. 3 and 4 below. In these drawings, the same reference numerals are used to denote the same components.

A pumping section 10 is provided comprising a circular pipe defining a torus and defining a circle in a plane 11 intersecting that torus. Further spatial references are with respect to the plane 11 and the circle therein. The pumping section 10 is preferably horizontally disposed. Fluid is provided through an inlet header 12 which communicates with the pumping section 10 through a plurality of channels 13. The inlet header 12 may comprise a circular pipe subtending an arc of a circle concentric with the first circle in the plane 11 or may subtend an arc of a circle in a plane parallel thereto. An outlet header 15 is provided for receiving centrifically pumped fluid from the pumping section 10. Channels 16 are provided to communicate the pumping section 10 to the outlet header 15. Preferably the outlet header 15 is a circular pipe subtending an arc concentric with an subtending an arc along a circle concentric with the first circle and larger than it or a circle in a plane parallel to the plane 11. Both the inlet header 12 and the outlet header 15 may be closed at a first end and opened at a second end. The inlet header 12 is shown communicating with an input tube 18 for connection to a source not shown, and the outlet header 15 is shown connected to an outlet tube 19 connected to a utilization means not shown.

Figure 1A:
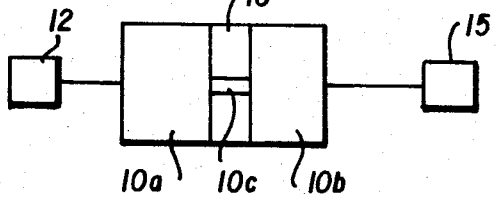
FIG. 1*a* is a schematic illustration of pump stages and illustrating a further form of the invention.

The relationship of inlet and outlet headers is shown schematically in FIG. 1*a* in which the pumping section 10 comprises a plurality of cascaded toroidal sections. They may be first and second concentric toroidal sections 10*a* and 10*b* mounted in the same vertical plane or may be equal toroidal sections vertically displaced from each other. The sections 10*a* and 10*b* are connected by channels 10*c*. Sections 10*a* and 10*b* are similar to pumping sections 10.

As further illustrated in FIG. 2, the above-described means may be supported to a base 20 by vertical support means 21. Power and control circuitry 25 are provided for connection to coils as further described with respect to FIGS. 3 and 4 below. One wall of the pumping section 10 includes a removable wall portion, or door, 30 further described with respect to FIG. 5 below. The pumping section 10 is made of substantially nonmagnetically saturable material. Suitable materials could include polyvinyl chloride, tempered glass or stainless steel, depending on desired characteristics with respect to the fluid being pumped.

Figure 3:
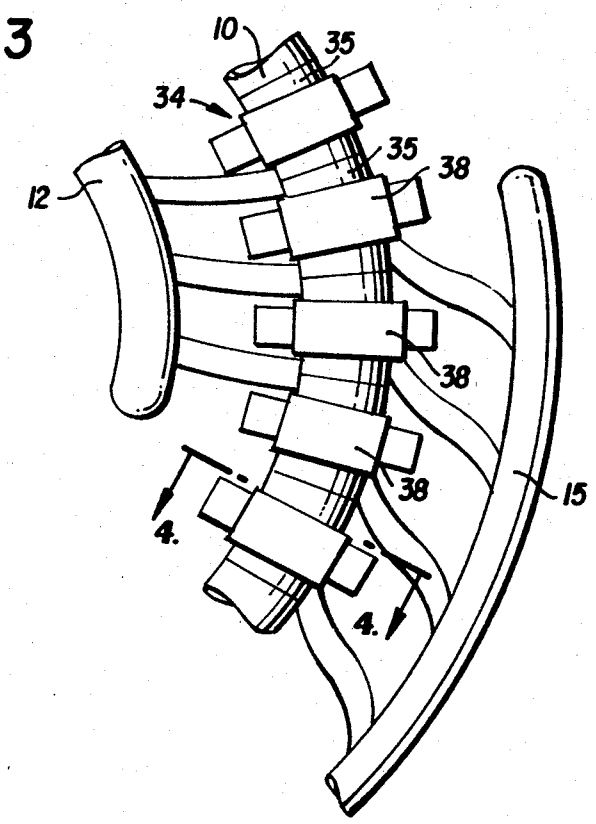
FIG. 3 is an enlarged, partial detailed view of the apparatus as illustrated in FIG. 1 and illustrating placement of windings thereon.
Figure 4:
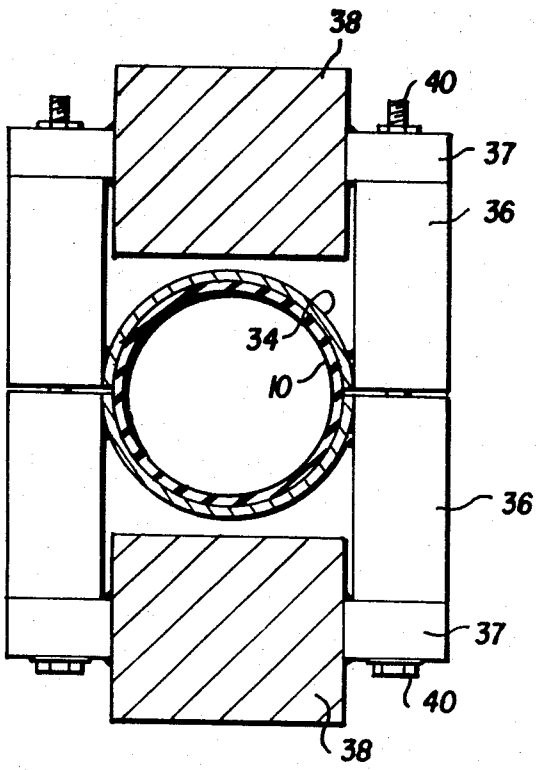
FIG. 4 is a partial, sectional view taken along lines 4—4 of FIG. 3 and illustrating placement of the winding.

As illustrated in FIGS. 3 and 4, which are respectively a partial detailed view of FIG. 1 and a cross-sectional view taken along lines 4—4 of FIG. 3, the pumping section 10 is surrounded by a conductive tube 34 which may comprise a plurality of sections 35 which are modular for ease in assembly. Core members 36 and 37 support coils 38, each of which are connected to the circuit 25. Fastening means 40 may be utilized to retain the core portions 36 and 37 together to surround successive angular portions of the pumping section 10. The sections of the tube 34 are formed to permit communication of channels 13, 16 or 10*c* therethrough.

Figure 5:
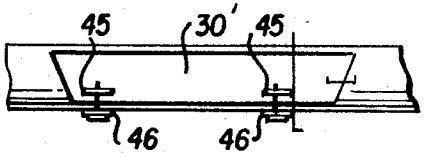
FIG. 5 is a partial, detailed illustration of the apparatus as illustrated in FIG. 2 demonstrating means for opening and closing the pumping section for insertion or removal of an impeller.

The coils 38 are preferably mounted both below and above the pumping section 10. Angularly displaced groups thereof may be defined. Each angularly displaced group is sequentially energized to provide a rotating field for inducing movement of magnetically saturable impeller means in the pumping section 10. When the means of FIG. 4 are disassembled, the door 30 (FIG. 1) is visible. As illustrated in FIG. 5, which is a partial, detailed view of FIG. 2, mounting flanges 45 are provided extending from the door 30 and fastening means 46 mount the door 30 into the pumping section 10 to completely close the wall thereof. The door 30 forms an arcuate wall and its projection may be trapezoidal. In this manner, sealing of the pumping section 10 is facilitated.

Figure 6:
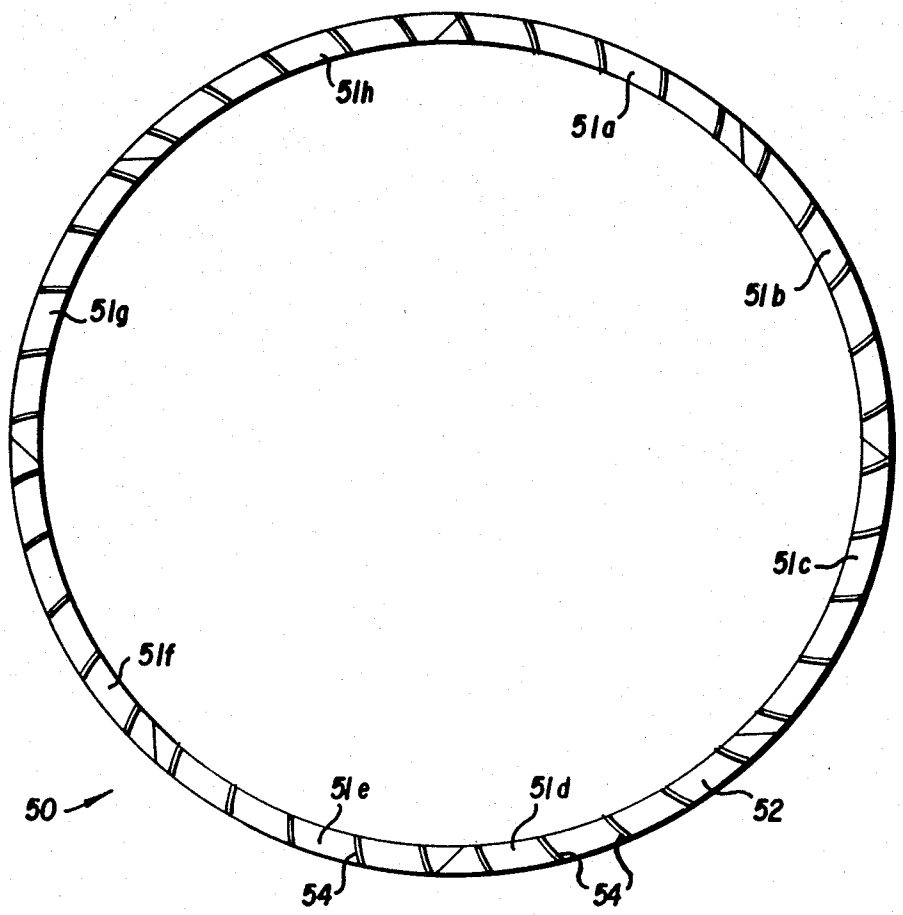
FIGS. 6 and 7 are respectively a plan and elevation of an impeller included in the present apparatus.
Figure 7:
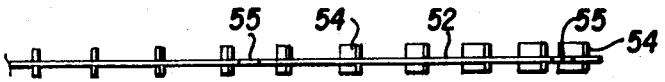

FIGS. 6 and 7 are respectively a plan and elevation of an impeller 50 comprising a plurality of arcuate sections 51*a* through 51*h*. The impeller 50 defines an annular disk 52 for disposal substantially in the plane 11 illustrated in FIG. 2. A plurality of centrifugal impeller vanes 54 are each mounted to the annular disk 52. In order to provide for modular assembly of the impeller 50, fastening means 55 are provided for fastening one end of each sector 51 to the other end of the next sector 51. The sections 51 may be placed one at a time through the opening defined by the door 30 (FIG. 2) fastened, slid in and then the process continued until all eight sections 51*a* through 51*h* have been inserted to assemble a complete impeller unit 50. The impeller 50 is composed of a series of elements of alternating ferrous, or magnetically saturable, and non-ferrous, or non-magnetically saturable, portions similar in structure and angularly displaced in groups. They are drivable in the manner described in my above-referenced patent to provide curvilinear motion.

OPERATION

Fluid entering the input hose 18 is drawn into the inlet header 12. The impeller 50 rotates in the counterclockwise direction as seen in FIG. 6. A pressure differential is created between the inlet channels 13 and the outlet channels 16. The circuit 25 energizes angularly displaced groups of coils 38 in sequence to continue rotation of the impeller 50. Liquid is delivered by the channels 16 to the outlet header 15 and may exit the outlet tube 19.

What is claimed as new and desired to be secured by Letters Patent of the United States is:

1. A centrifugal pump comprising a closed circular torus-shaped conduit for pumping fluids therein, an inlet header for delivering fluids to be pumped to said conduit, said inlet header being arranged concentrically and being inwardly spaced with respect to said conduit, a first set of a plurality of channels providing fluid communication between said inlet header and said conduit, an outlet header for delivering centrifugally pumped fluids from said conduit, said outlet header being arranged concentrically and being outwardly spaced with respect to said conduit and said inlet header, a second set of a plurality of channels providing fluid communication between said conduit and said outlet header, an impeller mounted in said conduit and being an annular disk having mounted thereon a plurality of centrifugal impeller vanes, said impeller rotating within said conduit to provide curvilinear motion to the fluids therein, and a plurality of stationary coil windings surrounding said conduit and spaced from one another along the conduit for supplying an electromagnetic force to induce and to continue the movement of the impeller within the conduit in order to drive the impeller therein.

2. A pump in accordance with claim 1 wherein said impeller includes a series of alternating ferrous and magnetically saturable portions, and a series of alternating non-ferrous and non-magnetically saturable portions.

3. A pump in accordance with claim 2 wherein the inlet header and the outlet header are each closed at one end and open at the other end.

4. A pump in accordance with claim 3 wherein the conduit is of a non-magnetically saturable material.

5. A pump in accordance with claim 4 wherein the conduit is surrounded by a conductive tube, said tube being arranged on said conduit in a plurality of sections.

6. A pump in accordance with claim 5 wherein the coils are arranged above and below the conduit, core members for supporting the coils above and below the conduit, and fastening means to retain the core members together in surrounding relationship to said conduit.

7. A pump in accordance with claim 6 wherein said conduit and the inlet and outlet headers are arranged in a substantially horizontal plane, a base member for supporting the conduit and the headers in said plane, and substantially vertical support means extending between the base member and the conduit and headers.

8. A pump in accordance with claim 7 wherein said conduit includes a door for opening and closing the pumping section of the conduit, said door being a removable wall portion of the conduit, flange means extending from the removable portion, and fastening means for mounting the removable portion into the conduit.

9. A pump in accordance with claim 8 wherein the impeller includes a plurality of separate sectors, and fastening means for fastening one end of each sector to the other end of the next sector to provide a modular impeller whereby the sectors of the impeller may be inserted into and removed from the conduit one at a time through the door in order to be assembled and disassembled.

10. A pump in accordance with claim 9 wherein a plurality of conduits is provided in a cascade fashion and being interconnected one to the other by channel means, each conduit functioning as a pumping section.

* * * * *